US006053350A

United States Patent [19]

Suitou et al.

[11] Patent Number: 6,053,350

[45] Date of Patent: Apr. 25, 2000

[54] SEALING PLUG DEVICE FOR A REFRIGERANT COMPRESSOR

[75] Inventors: Ken Suitou; Kazuaki Iwama; Hiroshi Uneyama; Atsuyuki Morishita, all of Kariya, Japan

[73] Assignee: Kabushiki Kaisha Toyoda Jidoshokki Seisakusho, Kariya, Japan

[21] Appl. No.: 09/233,848

[22] Filed: Jan. 19, 1999

[30] Foreign Application Priority Data

Jan. 21, 1998 [JP] Japan ..... 10-009445

[51] Int. Cl.[7] ..... B65D 45/00

[52] U.S. Cl. ..... 220/327; 220/254

[58] Field of Search ..... 220/242, 254, 220/327, 328, 361

[56] References Cited

U.S. PATENT DOCUMENTS

| | | | |
|---|---|---|---|
| 3,736,190 | 5/1973 | Dey et al. | 220/327 X |
| 5,458,257 | 10/1995 | Muckelrath et al. | 220/562 |
| 5,489,041 | 2/1996 | Mathews et al. | 220/562 |
| 5,573,139 | 11/1996 | Yeh | 220/360 |
| 5,868,558 | 2/1999 | Parker | 220/327 X |

FOREIGN PATENT DOCUMENTS 4-10478 3/1992 Japan .

*Primary Examiner*—Stephen K. Cronin

*Attorney, Agent, or Firm*—Woodcock Washburn Kurtz Mackiewicz & Norris LP

[57] ABSTRACT

A removable sealing plug device for protecting the interior of a refrigerant compressor from dust, dirt, and corrosion during storage and/or transport of the compressor before it is assembled into a refrigerating system, including a plug element made of a rubber material and having a body portion suitable for being sealingly fitted in an inlet and/or outlet port of the compressor and a columnar head portion formed in an upper face of the body portion, and a base plate having a through-hole in which the columnar head of the plug element is press-fitted, the through-hole of the base plate being provided with sawtooth-like projections to non-removably hold the columnar portion of the plug element and secure it to the outer portion of the compressor, by using an existing threaded hole and a screw bolt, to hold the plug element between the base plate element and the outer circumference of the compressor. The plug element and the base plate of the sealing plug device are concurrently removed from the inlet port and/or outlet port of the compressor due to a tight engagement of the plug element and the base plate provided by the sawtooth-like projections.

8 Claims, 3 Drawing Sheets

SEALING PLUG DEVICE FOR A REFRIGERANT COMPRESSOR

BACKGROUND OF THE INVENTION

1. Field of the Invention

The present invention relates generally to a refrigerant compressor and, more particularly, relates to a sealing plug device for tightly closing each of inlet and outlet ports of a refrigerant compressor so as to isolate the interior of the compressor from the atmosphere during either the storage of the compressors in a warehouse or the transporting of the compressors from e.g., the warehouse or the manufacturing factory to an automobile assembling site where the compressors are assembled in automobile refrigerating systems, for the purpose of protecting the interior of the compressor against corrosion, dirt and dust.

2. Description of the Related Art

Generally, refrigerant compressors are manufactured and assembled, as an important component of an automobile refrigerating system, in a compressor manufacturing factory. During the final stage of the assembly of respective compressors, each compressor is filled with lubricating oil used for lubricating the interior of the compressor during the operation of the compressor, and also preventing the interior of the compressor from being corroded. For example, as shown in FIG. 6, an inlet port 40*a* of the refrigerant compressor is formed in an outer portion of the compressor, i.e., a pipe connecting portion 40 to which suction and delivery pipes of a refrigerating system are connected. Therefore, after the filling of the lubricating oil into the interior of the compressor, the inlet port 40*a* of the compressor is covered with a cap member 50 made of a rubber to seal and isolate the interior of the compressor from the atmosphere. An outlet port (not shown in FIG. 6) of the compressor is also covered by a similar cap member or a plug member. Then, the compressors are transported from the manufacturing and assembling factory to an automobile manufacturing and assembling factory where each of the compressors is assembled in an automobile refrigerating system. Namely, during the assembly of the automobile refrigerating system, the compressor is connected to a condenser and an evaporator of the refrigerating system via the suction and delivery pipes, and pipe joints. Therefore, before assembling the compressor into the refrigerating system, the cap members 50 covering the inlet port and/or the outlet port must be removed so that the suction pipe can be connected to the inlet port 40*a* via the pipe connector. Similarly, the delivery pipe is connected to the outlet port of the compressor via the pipe connector after the removal of the cap from the outlet port.

FIG. 7 illustrates a different conventional sealing device used for sealing a port of a refrigerating fluid flowing passage, which is disclosed in Japanese Examined Utility Model Publication (Kokoku) No. 4-10478 published on Mar. 16, 1992. In FIG. 7, a sealing member 62 includes a stem portion 62*a* fitted in a mounting hole of a base plate 63, a sealing portion 62*b* arranged at an end of the stem portion 62*a* for closing a port end of the refrigerating fluid flowing passage 61 (a tapered portion of the port of the refrigerating fluid flowing passage) in a sealing condition, and a stop head portion 62*c* arranged at an opposite end of the stem portion 62*a* and formed as a large diameter portion capable of preventing the seal member 62 from coming out of the mounting hole of the base plate 63. When the seal member 62 is attached to a portion of a machine body in which the refrigerating fluid flowing passage 61 is formed, the base plate 63 having several through-holes 64 is fixed to the machine body by means of screws 66 threadedly engaged, via the through-holes 64, into screw holes 65 bored in the machine body around the refrigerating fluid flowing passage 61.

Nevertheless, the afore-described cap member 50 of the prior art is securely attached to the suction port 40*a* of the connecting portion 40 by using only the elasticity of the cap member 50 itself, and therefore, during the transportation of the compressor, the cap member 50 might be loosened due to vibration and shocks, and eventually might come out of the suction port 40*a*. Further, it often occurs that the compressors must be stocked in a store house before they are assembled in automobile refrigerating systems for a rather long time. Thus, when the compressors are stocked, they are filled with gas to protect the interior of each compressor from dust and dirt, and corrosion. The gas used for this purpose is either helium gas or nitrogen gas which is filled into the interior of the compressors after the respective compressors are evacuated so that the pressure of the gas is higher than the atmospheric pressure. Therefore, the high pressure of the gas may cause the loosening of the cap member 50, and allows the cap member 50 to come out of the suction port 40*a*.

Further, in the case of the afore-mentioned sealing device of JU-B-4-10478, prevention of the sealing member 62 from coming out of the mounting hole of the base plate 63 relies on only provision of a large-diameter-portion 62*c* at the end of the stem portion 62*a*. When the assembly of the sealing member 62 and the base plate 63 should be removed from the machine body 60 by unscrewing the screws 66 at the assembling site, since the shape of the tapered port of the refrigerating fluid passage 61 is very simple, the sealing portion 62*b* of the sealing member 62 can be easily disengaged from the tapered port. Nevertheless, if the sealing device of JU-B-4-10478 is applied to a refrigerant compressor for sealing an inlet and/or outlet port of a flange joint to which an external pipe is joined, the inlet and outlet ports of the flange joint are formed as bores having a generally complicated shape such as a multi-stage counter bores. Thus, the sealing portion 62*b* of the sealing member 62 once press-fitted in the inlet and/or outlet port cannot be easily removed. Therefore, the large-diameter portion 62*c* of the sealing member 62 might be unable to prevent the sealing member 62 from being separated from the base plate 63 when the assembly of the sealing member 62 and the base plate 63 is forcedly pulled away from the inlet and/or outlet port of the flange joint to disengage the sealing portion 62*b* from the port against a large frictional resistance. Thus, when the sealing device of JU-B-4-10478 is employed for sealing the inlet and/or outlet port of the flange joint of the refrigerant compressor, the diameter of the large-diameter portion 62*c* must be increased. However, an increase in the diameter of the large-diameter portion 62*c* of the sealing member 62 will make it difficult or impossible to mount the stem portion 62*a* of the sealing member 62 in the mounting bore of the base plate 63 even if the large-diameter portion 62*c* is made of an elastic material so that the portion 62*c* is elastically shrunk.

SUMMARY OF THE INVENTION

Therefore, an object of the present invention is to provide a sealing plug device, for a refrigerant compressor, having a reliable sealing performance able to surely close an inlet and/or outlet port of the refrigerant compressor and a dismounting performance allowing easy dismounting from the compressor without breakage.

Another object of the present invention is to provide a sealing plug device for a refrigerant compressor, formed as an assembly of a base element permitting the assembly to be firmly attached to a joint portion of the compressor, and a reliably plug element easily mounted on the base plate with an ability of strongly preventing itself from coming out of the base plate during the dismounting of the assembly from the compressor, and exhibiting a reliable sealing performance.

In accordance with the present invention, there is provided a sealing plug device for fluid-tightly closing at least one of inlet and outlet ports of a refrigerant compressor in which the inlet and outlet ports for refrigerant are formed in an outer part of the compressor so as to be connectable to suction and delivery pipes via pipe joints, the outer portion of the compressor being further provided with threaded holes formed at respective positions adjacent to the inlet and outlet ports so as to be used for fixing the pipe joints, the sealing plug device protecting the interior of the compressor from dust, dirt and corrosion, and comprising:

a plug element made of rubber material and including a body portion adapted to being tightly fitted in at least one of the inlet and outlet ports, and a columnar head formed in an upper surface of the body portion to be vertically projected from the upper surface; and a base plate element adapted for being mounted on the plug element to secure the plug element to the outer portion of the compressor by using one of the threaded holes, the base plate having a through-hole in which the columnar head of the plug element is fitted, wherein the through-hole of the base plate has a substantially cylindrical inner wall in which at least one substantially circular inward projection is formed to include a circularly extending innermost end having an inner diameter smaller than an outer diameter of the columnar head of the plug element, the circular projection further including a face portion tightly engageable with the columnar head when the columnar head is forcedly fitted in the through-hole in a predetermined direction to thereby prevent the columnar head from moving in a direction reverse to the predetermined direction, and an adjacent rear portion permitting the columnar head to be smoothly moved into the through-hole, the face portion and rear portion forming therebetween the innermost end of the circular projection.

Preferably, the through-hole of the base plate has a plurality of substantially circular inward projections formed in the cylindrical inner wall of the through-hole, and the circular projections are arranged one after another in a direction corresponding to the predetermined direction and provided with respective circular innermost ends having an identical inner diameter smaller than the outer diameter of the columnar head of the plug element. Each of the circular projections includes the face portion tightly engageable with the columnar head when the columnar head is forcedly fitted in the through-hole in the predetermined direction, to thereby prevent the columnar head from moving in the direction reverse to the predetermined direction, and the adjacent rear portion permitting the columnar head to be smoothly moved into the through-hole, the face portion and rear portion forming therebetween the innermost end of each circular projection.

Preferably, the circular inward projection of the through-hole of the base plate is formed as a single sawtooth-like projection having the face portion formed to extend substantially perpendicularly to a central axis of the through-hole, and the rear portion formed as an inclined surface portion with respect to the central axis of the through-hole, an inclination of the rear portion being selected so as to permit the columnar head of the plug element to be smoothly moved into the through-hole of the base plate.

Further, the plurality of circular projections of the through-hole of the base plate may preferably comprise a plurality of sawtooth-like parallel projections arranged one after another in the predetermined direction, and each of the sawtooth-like parallel projections has the face portion formed to extend substantially perpendicularly to a central axis of the through-hole and the rear portion formed as an inclined surface portion with respect to the central axis of the through-hole, an inclination of the rear portion being selected so as to permit the columnar head of the plug element to be smoothly moved into the through-hole of the base plate.

Alternatively, the plurality of circular projections of the through-hole of the base plate may comprise sawtooth-like threads formed by a projection extending spirally and continuously around a central axis of the through-hole of the base plate, each of the sawtooth-like threads has the face portion formed to extend substantially perpendicularly to the central axis of the through-hole and the rear portion formed as an inclined surface portion with respect to the central axis of the through-hole, an inclination of the rear portion being selected so as to permit the columnar head of the plug element to be smoothly moved into the through-hole of the base plate.

Preferably, the columnar portion of the plug element is provided with a tapered end formed at a top thereof for permitting the columnar portion of the plug element to be brought into a registration with the through-hole of the base plate when the plug element is mounted in the base plate.

BRIEF DESCRIPTION OF THE DRAWINGS

The above and other objects, features, and advantages of the present invention will be made more apparent from the ensuing description of the preferred embodiments thereof with reference to the accompanying drawings wherein.

THE DESCRIPTION OF THE PREFERRED EMBODIMENTS

Figure 1:
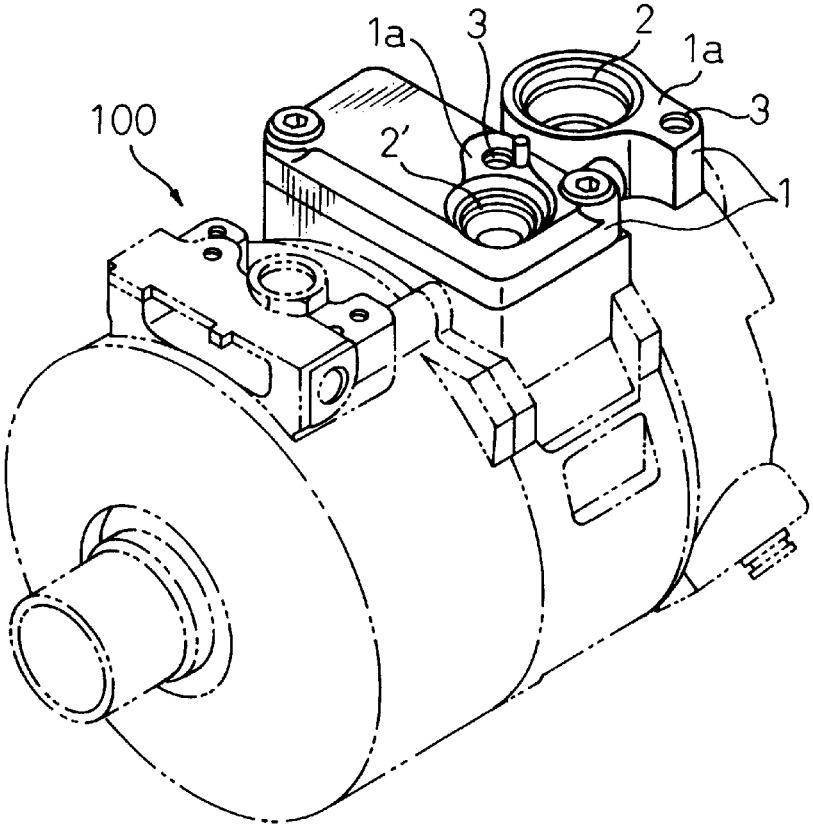
FIG. 1 is a general perspective view of a refrigerant compressor, illustrating an outer portion thereof in which an inlet port and an outlet port to be closed by a sealing plug device according to the present invention are provided to receive suction and delivery pipes of a refrigerating system.
Figure 2:
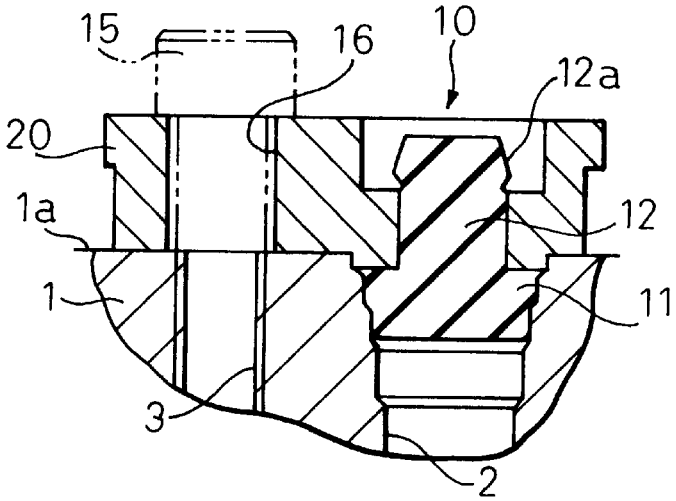
FIG. 2 is a sealing plug device according to an embodiment of the present invention, illustrating the device attached to a body of a refrigerant compressor.

Referring to FIG. 1, a refrigerant compressor 100 is provided with a housing assembly including a cylinder block, a front housing, and a rear housing. The housing assembly forms an outer framework of the refrigerant compressor and is provided with a compression mechanism therein for sucking and compressing a refrigerant gas within cylinder bores when the refrigerant gas returns from an external refrigerating system via a suction pipe. The compressed refrigerant gas is discharged by the compressing mechanism into a discharge chamber within the housing assembly, and is then delivered toward an external refrigerating system via a delivery pipe. The housing assembly is further provided with an outer portion formed as a pipe connecting portion 1 to which the suction pipe and the delivery pipe (not shown) of the refrigerating system, e.g., an automobile refrigerating system are connected. The connecting portion 1 has a mount 1*a* in which an inlet port 2 and a delivery port 2' are opened. The inlet and delivery ports 2 and 2' are arranged for being connected to the suction and delivery pipes via respective pipe joints to introduce a refrigerant gas for compression from, and to deliver the compressed refrigerant gas to, the external refrigerating system. The respective pipe joints are secured to the mount 1*a* by suitable screw bolts (not shown) threadedly engaged in threaded holes 3 formed in the mount 1*a* and arranged adjacent to the inlet and delivery ports 2 and 2'.

Description of a sealing plug device according to an embodiment of the present invention will be provided hereinbelow. However, it should be generally understood that a sealing plug device according to the present invention may be used for sealingly closing either one of the inlet and outlet ports 2 and 2' of the refrigerant compressor 100 or both of the ports 2 and 2' in order to protect the interior of the compressor from dust, dirt and corrosion before it is assembled into a refrigerating system.

FIGS. 2 through 5 illustrate one typical case where the sealing plug device according to the first embodiment of the present invention is used for closing the inlet port 2 of the refrigerant compressor 100.

Referring to FIGS. 2 through 5, the sealing plug device includes a plug element 10 made of rubber material. The plug element 10 is provided with a body portion 11 in the shape of a cylindrical bulge capable of being tightly fitted in the inlet port 2, and a columnar head portion 12 projecting from an upper face of the body portion 11. The columnar head portion 12 has a tapered end 12*a* formed at its uppermost end.

Figure 3:
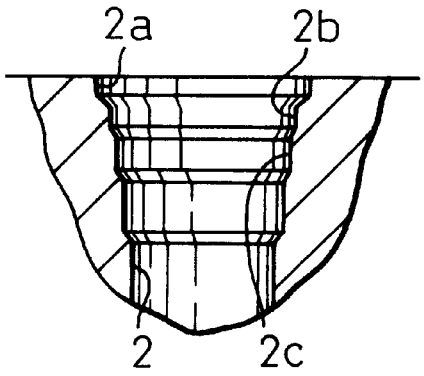
FIG. 3 is a cross-sectional partial view of a suction port of the refrigerant compressor.
Figure 5:
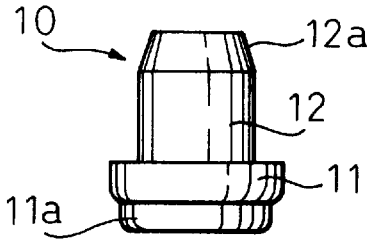
FIG. 5 is a front view of a sealing plug element of the sealing plug device according to the embodiment of the present invention.
Figure 6:
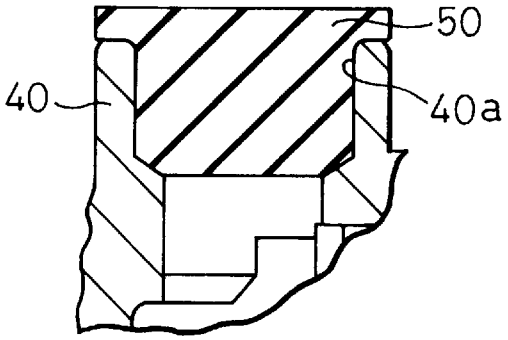
Fig.6 (PRIOR ART)
FIG. 6 is a cross-sectional view of a sealing plug device according to a prior art.
Figure 7:
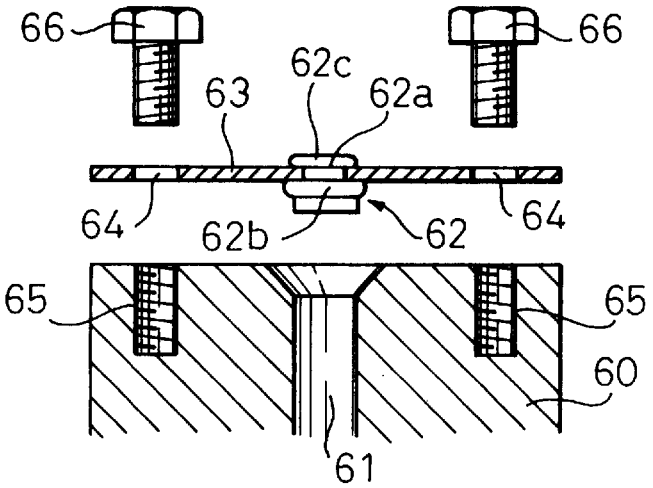
Fig.7 (PRIOR ART)
FIG. 7 is a cross-sectional view of a cross-sectional view of a sealing plug device according to a different prior art.

As best shown in FIG. 3, the suction port 2 formed as a flange port is provided with a multi-step counter bore having at least a first uppermost shallow counter bore portion 2*a* in which a cylindrical base portion of the pipe joint is fitted, a second deep counter bore portion 2*b* in which a sealing element of the pipe joint is closely seated, and a third deeper counter portion 2*c* in which a cylindrical end of the pipe joint is fitted. The first through third counter bore portions 2*a* through 2*c* are chamfered at their lowest corners, respectively. It should be noted that the inlet port 2 of the pipe connecting portion 1 is sealingly closed by the plug element 10 of the sealing plug device when the body portion 11 is tightly fitted in the second counter bore 2*b*. Thus, an innermost end portion 11*a* of the body portion 11 which has a smaller diameter, as shown in FIG. 5, is formed as a supplemental support portion having no sealing function.

The sealing plug device of the first embodiment further includes a base plate 20 cooperating with the above-mentioned plug element 10. The base plate 20 is provided with a cylindrical boss 21 formed so as to be fitted in the first uppermost counter bore 2*a* of the port 2 of the pipe connecting portion 1 and a mounting bore 16 through which a screw bolt 15 is threadedly engaged in one of the threaded holes 3 of the pipe connecting portion 1 to fix the base plate 20 to the pipe connecting portion 1. The base plate 20 is further provided with a through-hole 13 formed to be coaxial with the cylindrical boss 21 and having a chamfered open end formed in the cylindrical boss portion 21 and an opposite counter-bored open end. The through-hole 13 is provided for receiving the columnar head portion 12 of the plug element 10 so that the columnar head portion 12 is press-fitted or interference-fitted in the through-hole 13 when the plug element 10 is forcedly inserted into the through-hole 13 so that the same element 10 is moved from the chamfered end of the through-hole 13 toward the counter bore end of the through-hole 13. The through-hole 13 of the base plate 20 has a bore diameter which is smaller than an outer diameter of the columnar head portion 12 of the plug element 10 before the same element 10 is fitted in the through-hole 13. Thus, the columnar head portion 12 of the plug element 10 can be elastically deformed and press-fitted in the through-hole 13 of the base plate 20. Further, the inner cylindrical wall of the through-hole 13 of the base plate is provided with one or more inward projections 14 typically formed as one or more saw teeth in which each tooth has a face portion 14*a* extending substantially perpendicularly to a central axis of the through-hole 13, a rear portion 14*b* arranged to be inclined with respect to the same central axis of the through-hole 13, and a gullet 14*c* extending between the rear portion 14*b* and a neighboring face edge 14*a*. When a plurality of projections 14 are arranged in the inner cylindrical wall of the through-hole 13, the projections 14 may be either circularly extending saw teeth arranged to be parallel with one another or spirally and continuously extending sawtooth-like threads which may be more easily formed by the use of a screw lathe.

Figure 4A:
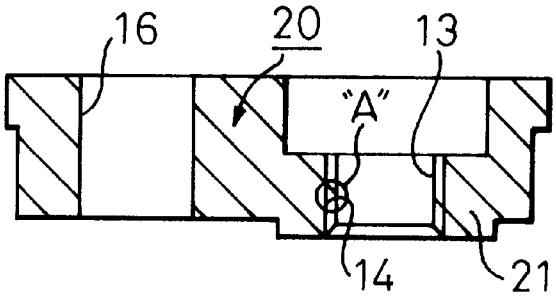
FIG. 4A is a cross-sectional view of a base plate of the sealing plug device according to the embodiment of the present invention.
Figure 4B:
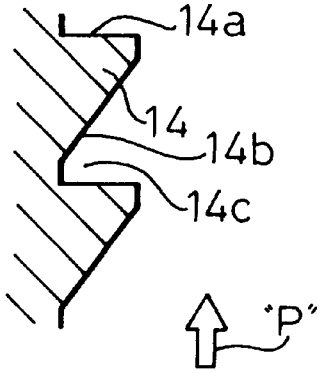
FIG. 4B is an enlarged cross-sectional and partial view of a portion "A" of a through-hole formed in the base plate, illustrating the shape of an inward projection formed in a cylindrical wall of the through-hole.

As is understood from the enlarged cross-sectional view of the projections 14 of FIG. 4B, the face portion 14*a* of each projection 14 functions to be firmly engaged with the columnar head portion 12 of the plug element 10 when the latter element 10 is press-fitted in the through-hole 13 so as to prevent the columnar head portion 12 from loosening and coming out of the through-hole 13 even if a strong pulling force is applied to the plug element 10 press-fitted in the base plate 20. Further, the inclined rear portion 14*b* of the projection 14 of the through-hole 13 has a function permitting the columnar head portion 12 of the plug element 10 to be smoothly moved into the through-hole 13 of the base plate 20 along an arrow "p" in FIG. 4B.

When the sealing plug device according to the embodiment of the present invention is assembled before it is attached to the inlet port 2 of the mount 1*a* of the refrigerant compressor, the tapered end 12*a* of the columnar head portion 12 of the plug element 10 is initially brought into registration with the chamfered open end of the through-hole 13 of the base plate 20, and the columnar head portion 12 is subsequently press-fitted into the through-hole 13. The tapered end 12*a* of the columnar head portion 12 is effective for centering the columnar head portion 12 with the through-hole 13, so that the press-fitting of the plug element 10 in the base plate 20 can be made easy and sure in response to an elastic reduction in the outer diameter of the columnar head portion 12.

When the assembly of the plug element 10 and the base plate 20 is completed, the sealing-plug device is sealingly attached to the compressor 100 by press-fitting the body portion 11 of the plug element 10 in the inlet port 2 of the compressor 100 in which a suitable amount of lubricating oil is supplied. At this stage, the mounting bore 16 of the base plate 20 is appropriately brought into registration with the threaded hole 3 of the mount 1*a,* so that the screw bolt 15 can be threadedly engaged in the threaded hole 3. Subsequently, the body portion 11 of the plug element 10 is press-fitted in the second counter bore 2*b* of the inlet port 2 of the mount 1*a*. At this stage, the cylindrical boss 21 of the base plate 20 is concurrently fitted in the first counter bore 2*a* of the inlet port 2, so that the lower face of the base plate 20 is closely seated on the upper face of the mount 1*a* of the pipe connecting portion 1. Then, the screw bolt 15 is threadedly engaged in the threaded hole 3 in order to tightly and stably fix the base plate 20 and the plug element 10 to the pipe connecting portion 1 of the compressor. Subsequently, a needle of the syringe (not shown) can pierce through the plug element 10 into the interior of the housing assembly of the compressor 100 and the evacuation of the interior of the housing assembly and the filling of a specific gas for protecting against corrosion of the interior of compressor 100 can be conducted. When the evacuation and filling of the specific gas are completed, the protection of the interior of the compressor against dust and dirt is also completed.

The refrigerant compressors protected by the sealing plug device from the dust, dirt and corrosion are forwarded to either a subsequent stage of assembling the compressors into refrigerating systems or a warehouse, as stock, as required.

When each of the compressors provided with the sealing plug devices is transported to the site of assembling it into a designated refrigerating system, the sealing plug device must be removed so that the suction and delivery pipes are connected to the inlet and outlet ports 2 and 2' of the compressor. The removal of the sealing plug device can be simply conducted by simultaneously pulling the base plate 20 together with the plug element 10 from the inlet port 2 and/or the outlet port 2' of the compressor 100 by using a suitable handle portion provided in a portion of the base plate 20. Even if the quality of the rubber material of which the plug element 10 is degraded so as to reduce an elasticity of the plug element 10 due to e.g., the storage in the warehouse for a long time, a tight engagement of the columnar head portion 12 of the plug element 10 with the projections 14 of the through-hole 13 of the base plate 20 can surely prevent the plug element 10 from being separated from the base plate 20 during the removal of the sealing plug device from the mount 1*a* of the compressor 100. Consequently, the sealing plug device consisting of the assembly of the plug element 10 and the base plate 20 can be surely taken out of the pipe connecting portion 1 of the compressor 100. Then, the inlet and outlet ports 2 and 2' of the compressor from which the sealing plug device is removed are connected to the suction and delivery pipes by using the pipe joints.

Various changes and modifications to the sealing plug device according to the described embodiment may be made by persons skilled in the art. For example, the cylindrical boss 21 of the base plate 20 may be omitted to form a flat bottom face of the base plate 20 if a corresponding boss portion is formed in the plug element 10 at a position between the base portion of the columnar head portion 12 and the body portion 11.

From the foregoing description of the preferred embodiments of the present invention, it will be understood that, in accordance with the present invention, the sealing plug device for protecting the interior of a refrigerant compressor can be an easily and removably attached device and can surely and reliably seal the inlet and/or outlet port of the compressor without unpredictably being loosened and coming out of these ports even if vibrations and shocks are applied to the sealing plug device during the transportation of the refrigerant compressor.

What we claim:

1. A sealing plug device for fluid-tightly closing at least one of inlet and outlet ports of a refrigerant compressor in which the inlet and outlet ports for a refrigerant are formed in an outer part of the compressor so as to be connectable to suction and delivery pipes via pipe joints, the outer portion of the compressor being further provided with threaded holes formed at respective positions adjacent to the inlet and outlet ports so as to be used for fixing the pipe joints, the sealing plug device protecting the interior of the compressor from dust, dirt and corrosion, and comprising:

a plug element made of rubber material and including a body portion suitable for being tightly fitted in at least one of said inlet and outlet ports, and a columnar head formed in an upper surface of said body portion to be vertically projecting from said upper surface; and a base plate adapted for being mounted on said plug element to secure said plug element to said outer portion of said compressor by using one of said threaded holes, the base plate having a through-hole in which said columnar head of said plug element is fitted, wherein said through-hole of said base plate has a substantially cylindrical inner wall in which at least one substantially circular inward projection is formed to include a circularly extending innermost end having an inner diameter smaller than an outer diameter of said columnar head of said plug element, said circular projection further including a face portion tightly engageable with said columnar head when said columnar head is forcedly fitted in said through-hole in a predetermined direction to thereby prevent said columnar head from moving in a direction reverse to the predetermined direction, and an adjacent rear portion permitting said columnar head to be smoothly moved into said through-hole, said face portion and rear portion forming therebetween said innermost end of said circular projection of said base plate.

2. A sealing plug device according to claim 1, wherein said circular inward projection of said through-hole of said base plate is formed as a single sawtooth-like projection having said face portion formed to extend substantially perpendicularly to a central axis of said through-hole, and said rear portion formed as an inclined surface portion with respect to the central axis of said through-hole, an inclination of said rear portion being selected so as to permit said columnar head of said plug element to be smoothly moved into said through-hole of said base plate.

3. A sealing plug device according to claim 1, wherein said through-hole of said base plate has a plurality of substantially circular inward projections formed in said cylindrical inner wall of said through-hole, and said circular projections being arranged one after another in a direction corresponding to said predetermined direction and provided with respective circular innermost ends having an identical inner diameter smaller than said outer diameter of said columnar head of said plug element, each of said circular projections including said face portion tightly engageable with said columnar head when said columnar head is forcedly fitted in said through-hole of said base plate in said predetermined direction, to thereby prevent said columnar head from moving in the direction reverse to said predetermined direction, and said adjacent rear portion permitting said columnar head to be smoothly moved into said through-hole, said face portion and rear portion forming therebetween said innermost end of each of said circular projections.

4. A sealing plug device according to claim 3, wherein said plurality of circular projections of said through-hole of said base plate comprise a plurality of sawtooth-like parallel projections arranged one after another in said predetermined direction, each of said sawtooth-like parallel projections having said face portion formed to extend substantially perpendicularly to a central axis of said through-hole and said rear portion formed as an inclined surface portion with respect to the central axis of said through-hole, and an inclination of said rear portion being selected so as to permit said columnar head of said plug element to be smoothly moved into said through-hole of said base plate.

5. A sealing plug device according to claim 3, wherein said plurality of circular projections of said through-hole of said base plate comprise sawtooth-like threads formed by a projection extending spirally and continuously around a central axis of said through-hole of said base plate, each of said sawtooth-like threads having said face portion formed to extend substantially perpendicularly to the central axis of said through-hole and said rear portion formed as an inclined surface portion with respect to the central axis of said through-hole, and an inclination of said rear portion being selected so as to permit said columnar head of said plug element to be smoothly moved into said through-hole of said base plate.

6. A sealing plug device according to claim 1, wherein said columnar portion of said plug element is provided with a tapered end formed at a top thereof for permitting said columnar portion of said plug element to be brought into a registration with said through-hole of said base plate when said plug element is mounted in said base plate.

7. A sealing plug device according to claim 1, wherein said body portion of the plug element is formed as a circular bulge seated in a predetermined counter bore formed in an open end of each of said inlet and outlet ports of said compressor.

8. A sealing plug device according to claim 1, wherein said base plate has upper and lower opposite faces, said lower face being in contact with said outer portion of said compressor when said sealing plug device is attached to said outer portion, said lower face being provided with a cylindrical boss suitable for being seated in an uppermost counter bore formed in an open end of each of said inlet and outlet ports of said compressor.

* * * * *